US008302813B2

(12) United States Patent
Chen

(10) Patent No.: US 8,302,813 B2
(45) Date of Patent: Nov. 6, 2012

(54) HIGH EFFICIENCY CHEMICAL CONNECTING DEVICE AND LIQUID CHEMICAL DISPENSING SYSTEM USING THE SAME

(76) Inventor: Chun-Hung Chen, Taipei (TW)

( * ) Notice: Subject to any disclaimer, the term of this patent is extended or adjusted under 35 U.S.C. 154(b) by 325 days.

(21) Appl. No.: 12/816,754

(22) Filed: Jun. 16, 2010

(65) Prior Publication Data

US 2011/0309114 A1 Dec. 22, 2011

(51) Int. Cl.
*B67D 1/00* (2006.01)

(52) U.S. Cl. ..... 222/83; 222/541.2

(58) Field of Classification Search ..... 222/83, 222/80–82, 83.5, 85–88, 5, 464.1, 541.2
See application file for complete search history.

(56) References Cited

U.S. PATENT DOCUMENTS 6,109,480 A * 8/2000 Monsrud et al. ..... 222/83
6,425,502 B1 * 7/2002 Rauworth et al. ..... 222/400.7
6,883,682 B2 * 4/2005 Anderson ..... 222/83
6,918,710 B2 * 7/2005 Budds et al. ..... 401/132
6,957,745 B2 * 10/2005 Thibault et al. ..... 215/249
6,997,351 B2 * 2/2006 Cho ..... 222/82
2009/0020176 A1 * 1/2009 Hasegawa et al. ..... 137/614.05

* cited by examiner

*Primary Examiner* — Lien Ngo
(74) *Attorney, Agent, or Firm* — Cantor Colburn LLP

(57) ABSTRACT

A connecting device for ensuring proper connection of liquid containers is provided. The connecting device comprises a bottle closure having a dip tube passage and a first key code pattern at the top. A rupturable film is disposed in the bottle closure. A connector is provided for coupling with the bottle closure. The connector has an upper member and a lower member. The bottom surface of the upper member has a second key code pattern configured to mate with the first key code pattern. The lower member is pivotally coupled to the upper member. A dip tube penetrates the upper member of the connector. A pre-check member having a puncturing structure for puncturing through the rupturable film is also provided. The pre-check member has a key code pattern substantially identical to the second key code pattern to mate with the first key code pattern.

16 Claims, 10 Drawing Sheets

HIGH EFFICIENCY CHEMICAL CONNECTING DEVICE AND LIQUID CHEMICAL DISPENSING SYSTEM USING THE SAME

BACKGROUND OF THE INVENTION

1. Field of the Invention

The present invention relates to a connecting device and an liquid dispensing system for dispensing liquid chemicals during semiconductor manufacturing processes. In particular, the present invention relates to a connecting device and a liquid chemical dispensing system having a key code mechanism and a sloping container seat to provide higher chemical handling security and better dispensing efficiency.

2. Description of Related Art

Semiconductor manufacturing processes require the use of liquid chemicals such as acids, solvents, photoresists, inorganics, organics, biological solutions, pharmaceuticals, and radio-active chemicals. A dispensing device effectively delivers chemicals from different containers to various stages of a manufacturing process via a single connecting device. A successful manufacturing operation relies on the handling personnel to correctly connect the proper liquid chemical sources to the manufacturing system. It is critical for the handling personnel to install the proper chemical to the manufacturing system. However, the manufacturing environment is often dark, and the handling personnel who suffer reduced visibility may be likely to install incorrect chemical sources to the system, thus causing manufacturing failures. Moreover, incorrectly connected chemicals may contaminate the tubing of the manufacturing devices. Conventional dispensing devices do not provide a safety mechanism to address this problem. Also, conventional dispensing devices employ chemical containers with flat bottoms. The flat mounting configuration of the conventional liquid dispensing system suffers an inherent deficiency, as a dip tube in the flat-bottomed container has greater difficulty in reaching the liquid on the flat bottom surface. As a result, a greater amount of liquid residual may remain in the container. The remaining liquid chemical is therefore wasted.

SUMMARY OF THE INVENTION

An objective of the present invention is to provide a connecting device and a liquid dispensing system. The system employs a key code safety mechanism to ensure a proper connection between the correct chemical source and the correct manufacturing process. The system also reduces liquid residual in a chemical container and thus provides better efficiency in chemical usage.

To achieve the above objectives, the instant disclosure provides a connecting device to ensure proper connection of a chemical source to a manufacturing process. The connecting device comprises a bottle closure having a dip tube passage and a first key code pattern on a top end. A rupturable film is disposed on the bottle closure to cover the dip tube passage. A connector unit is provided for coupling with the bottle closure. The connector unit has an upper member and a lower member. The bottom surface of the upper member has a second key code pattern configured to mate with the first key code pattern on the bottle closure. The lower member is pivotally coupled to the upper member. The upper member of the connector has a dispensing outlet. A dip tube passes through the upper member of the connector and connects to the dispensing outlet. A pre-check member having a puncturing structure is provided for puncturing through the rupturable film on the bottle closure. The per-check member has a key code pattern substantially identical to the second key code pattern on the puncturing surface. The key code pattern on the pre-check member is also configured to mate with the first key code pattern on the bottle closure. The film on the bottle enclosure will be pierced through only when a puncturing member having a correct key code pattern is used. The pre-check member can be movably connected to the connector unit to provide easy access and prevent lose. In one embodiment, the pre-check unit is hanged around the connector by a string.

The instant disclosure also provides a liquid chemical dispensing system utilizing the above-mentioned connecting device for safely dispensing liquid chemicals. The liquid chemical dispensing system comprises an accommodating seat having a sloping supporting surface. A liquid container is supported on the sloping surface of the seat unit. The connecting device discussed above is utilized to connect the liquid container to a manufacturing process. In the liquid dispensing system, one end of the dip tube connects to a dispensing outlet on the connector, while the other end extends downward following the sloping surface of the seat. The slope mounting configuration of the container forces remaining liquid in the container to gather around the lower end of the dip tube, ensuring better liquid utilization. Furthermore, the liquid container can have a sloping bottom surface to match the sloping supporting surface of the seat unit.

For the ease of understanding, references are made to the following detailed description to illustrate various embodiments and examples of the instant disclosure. However, the description is for illustrative purpose only and is not intended to limit the scope of the present disclosure.

DETAILED DESCRIPTION OF THE PREFERRED EMBODIMENTS

Figure 1:
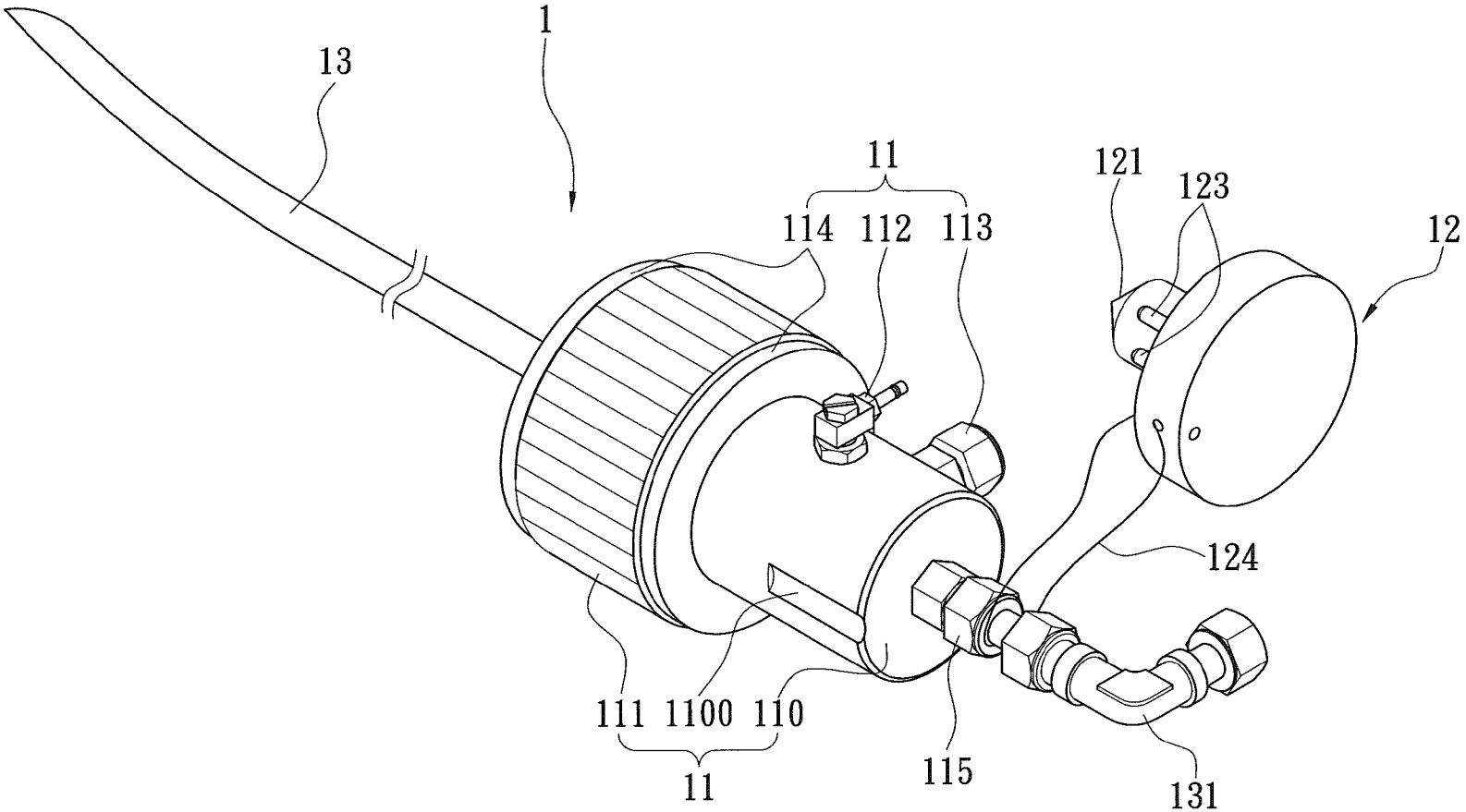
FIG. 1 is a schematic view showing a connector and a pre-check member of the present invention.
Figure 2:
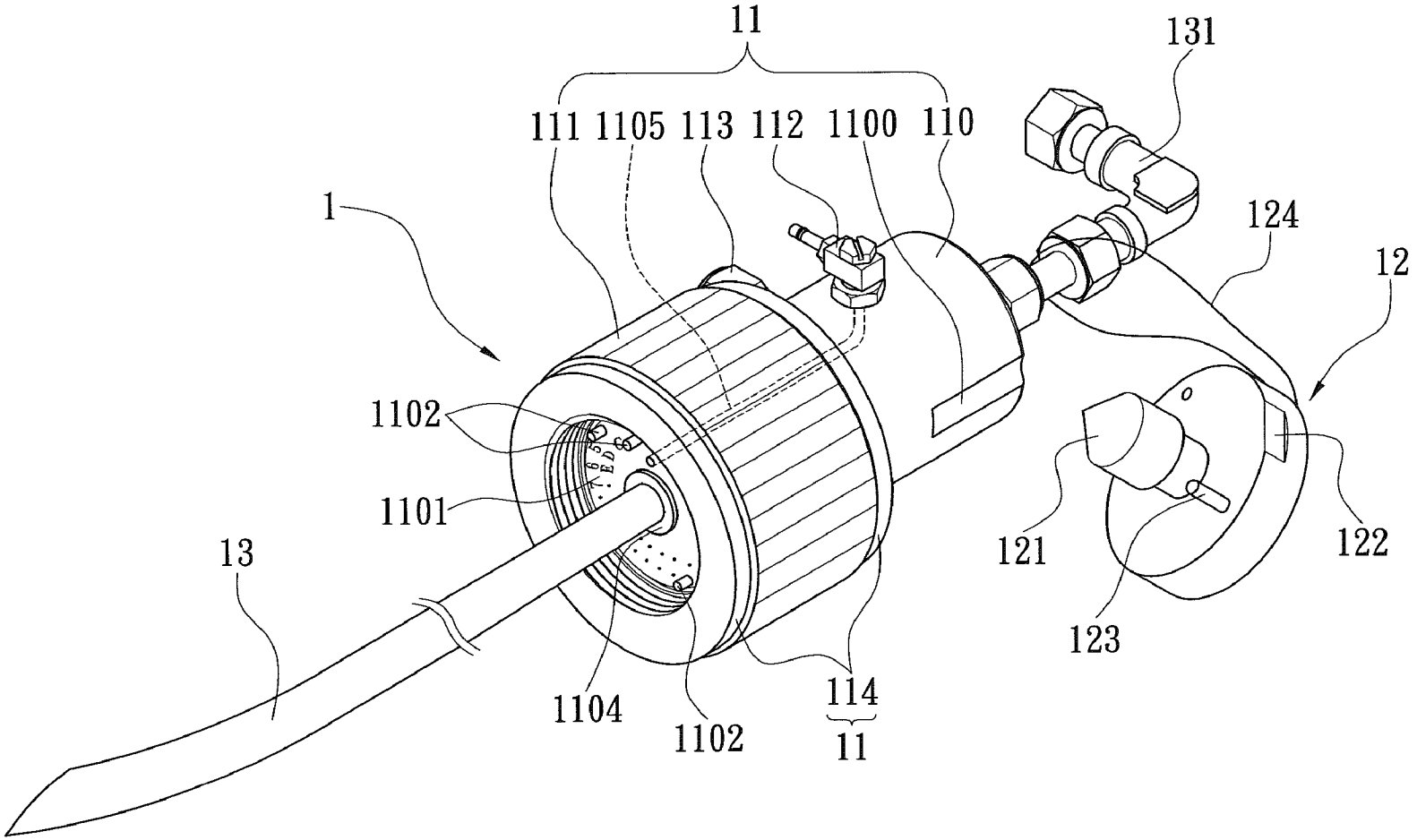
FIG. 2 is another schematic view showing the connector and the pre-check member of the present invention.

Reference is made to FIG. 1 to FIG. 9. FIG. 1-9 show a connecting device 1 for coupling with a container 2 comprises a bottle closure 14, a rupturable film 15 (FIG. 3), a connector 11, a pre-check member 12 and a dip tube 13. The bottle closure 14 for coupling with a mouth 21 of the container 2 has a dip tube passage 140 and a first key code pattern 141 at the top. In this embodiment, the first key code pattern 141 has a plurality of numbers and letters surrounding the dip tube passage 140. The first key code pattern 141 has three holes 142. The side wall of the bottle closure 14 has a first mark 143. The first mark 143 is a triangle in the present example, but the shape of the mark is not limited to the illustration in the drawings. The shape and number of the first key code pattern 141 are not limited to the illustration in the drawings, too.

Figure 11:
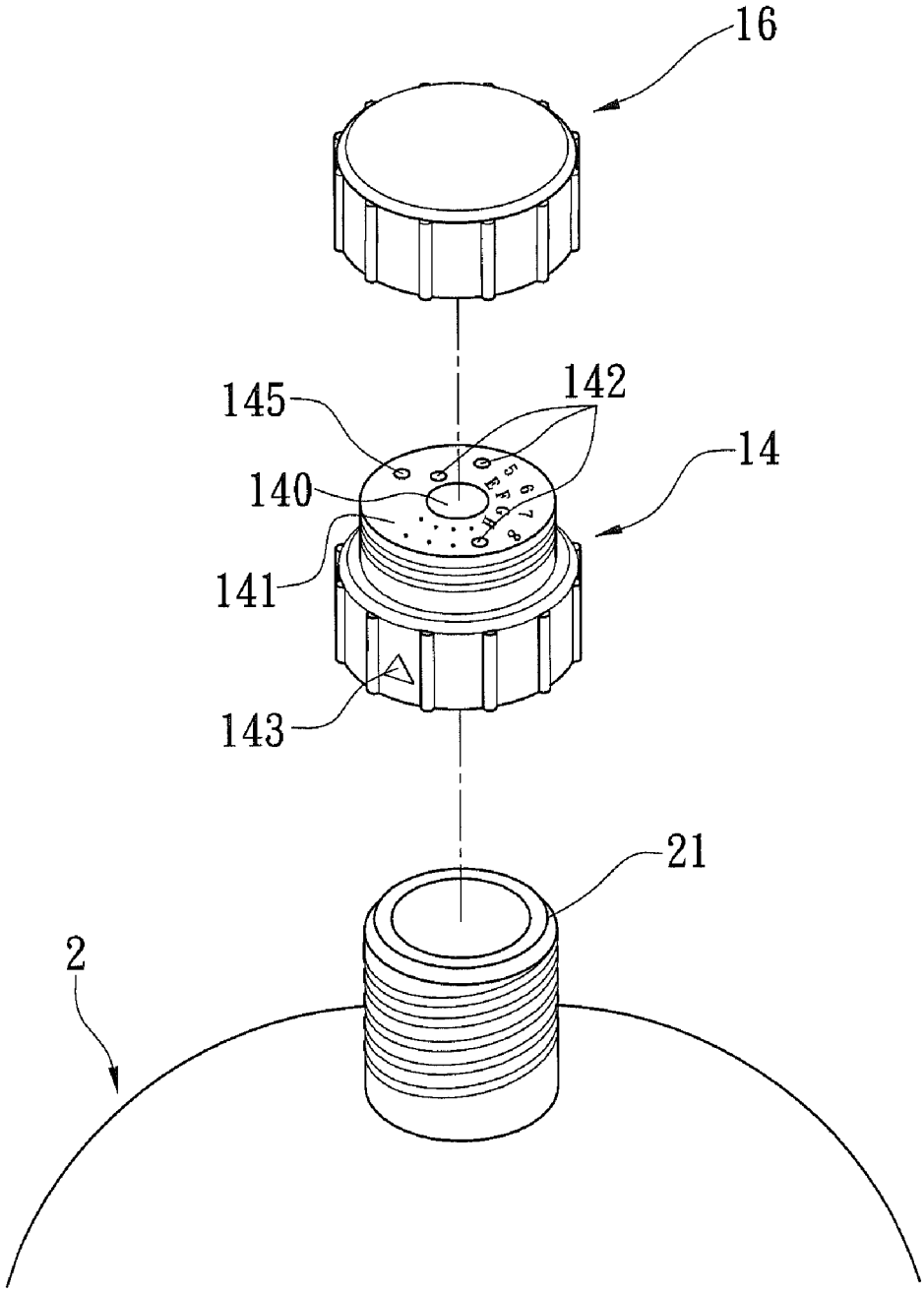
FIG. 11 is an exploded perspective view showing a container used a cover for engaging the external threads of the bottle closure.

Furthermore, the bottle closure 14 has external threads on the top end and has internal threads and a flange 144 on the bottom end. The rupturable film 15 is disposed in the bottle closure 14, and the edge of the rupturable film 15 is placed on the flange 144. When the bottle closure 14 is secured to the liquid container 2, a seal will be formed between flange 144 and mouth 21 (please refer to FIG. 9). Furthermore, before the container 2 is used, a cover 16 are used to engage the external threads of the bottle closure 14 (please refer to FIG. 11).

Figure 9:
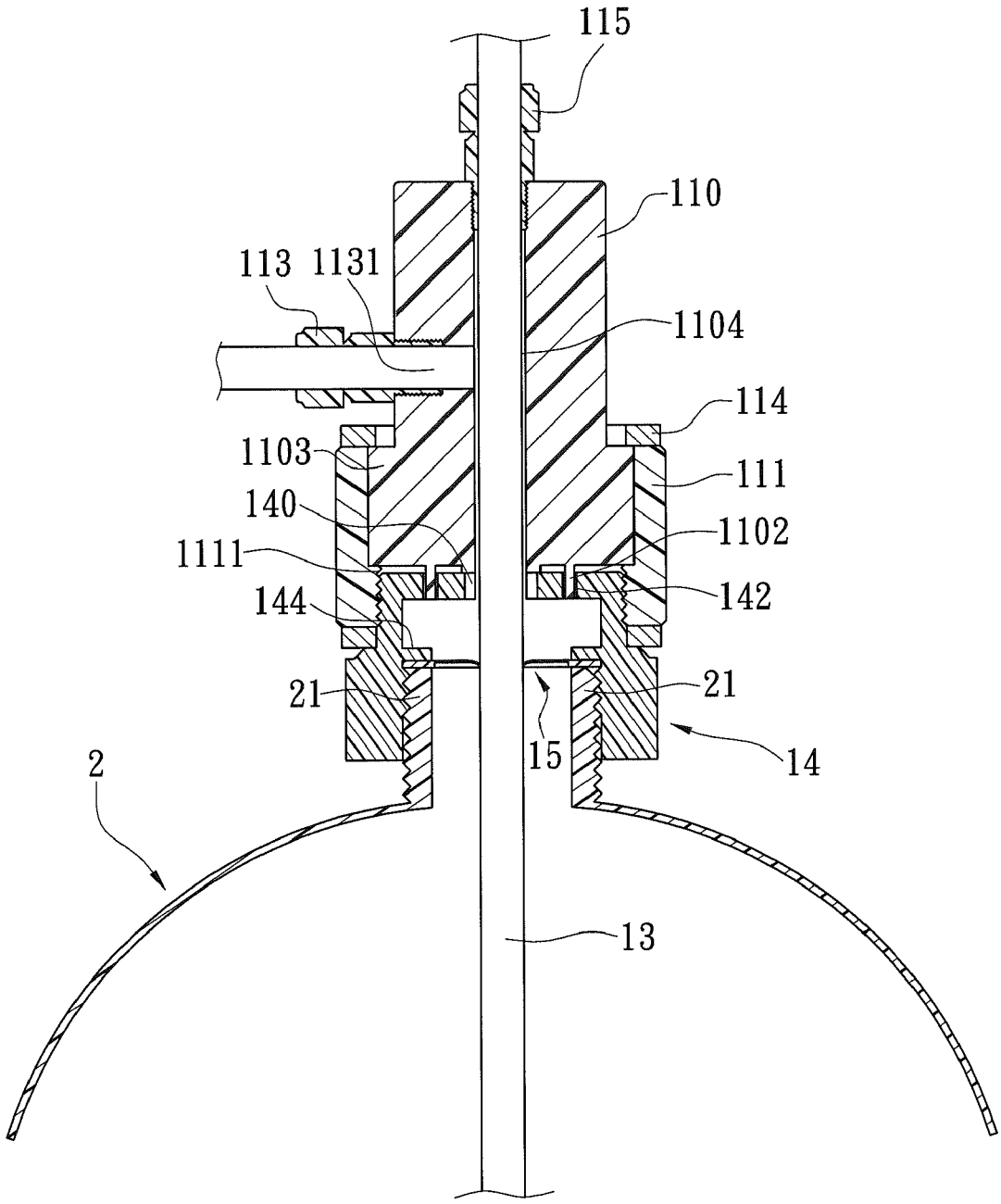
FIG. 9 is an application cross-section view showing the connecting device of the present invention.

The connector 11 has an upper member 110 and a lower member 111. The upper member 110 is shaped into a column and has a tubular passage 1104 therethrough (shown in FIG. 2). The bottom surface of the upper member 110 has a second key code pattern 1101. The second key code pattern 1101 has three pillars 1102 protruded downwardly. The side wall of the upper member 110 has a second mark 1100 thereon. The shape of the second mark 1100 is a notch in the instant example, but the shape of the mark is not limited to the illustration in the drawings. The shape and number of the second key code pattern 1101 are not limited to the illustration in the drawings, too. When the second mark 1100 aligns the first mark 143, the three pillars 1102 on the connector 11 are configured to mate with the three holes 142 on the bottle closure 14. The lower member 111 is shaped into a ring having a bigger diameter than the upper member 110. The lower member 111 is pivotally coupled to the upper member 110. Reference is now made to FIG. 9. Two fixing rings 114 are fixed on the lower member 111 respectively to prevent the smaller upper member 110 from sliding off the lower member 111. The dip tube 13 passes through the tubular passage 1104 of the upper member 110 of the connector 11 and the dip tube passage 140 of the bottle closure 14. The dip tube 13 can be fixed by a screw 115.

Figure 3:
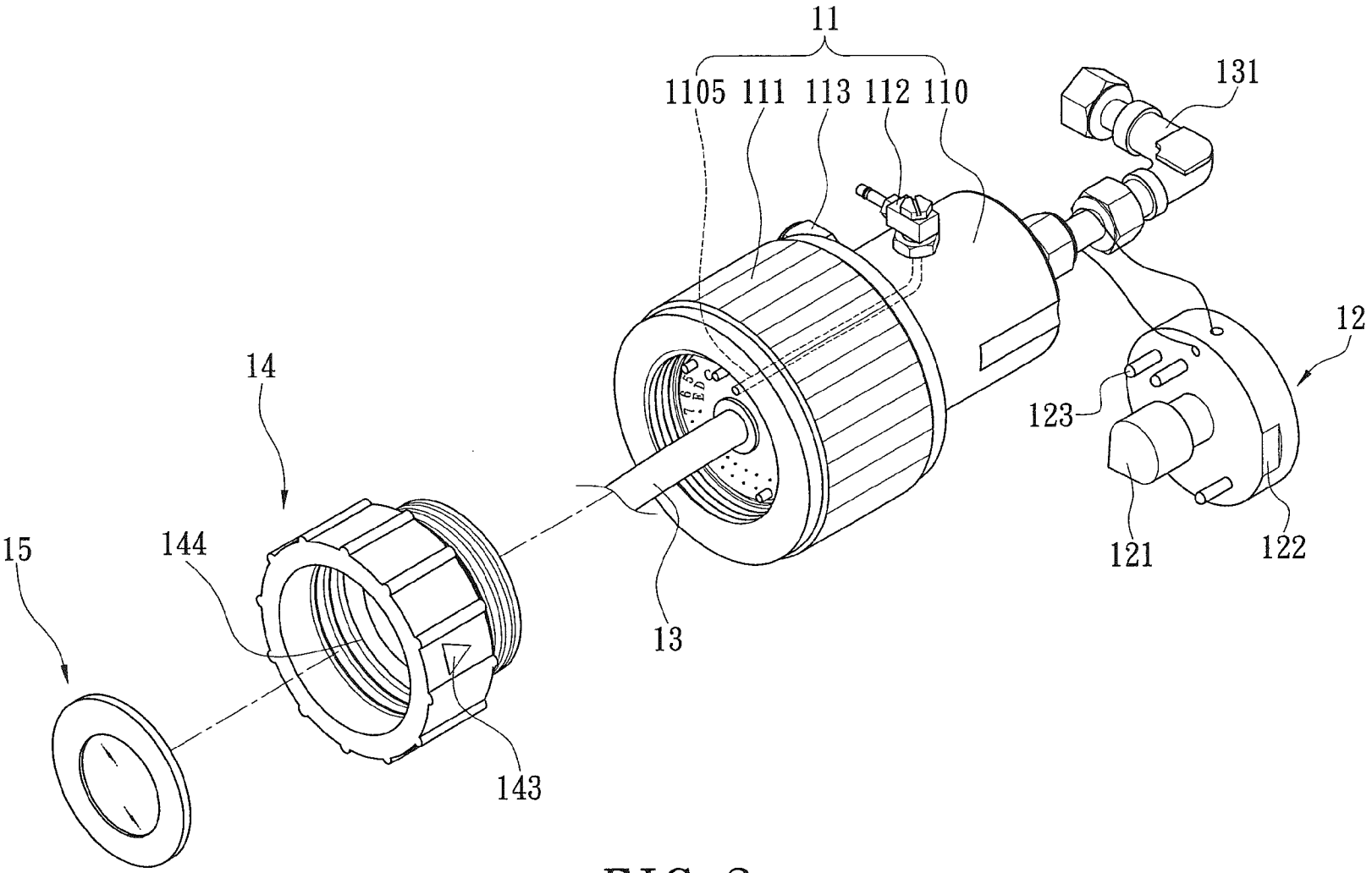
FIG. 3 is a schematic view showing a connecting device of the present invention.
Figure 4:
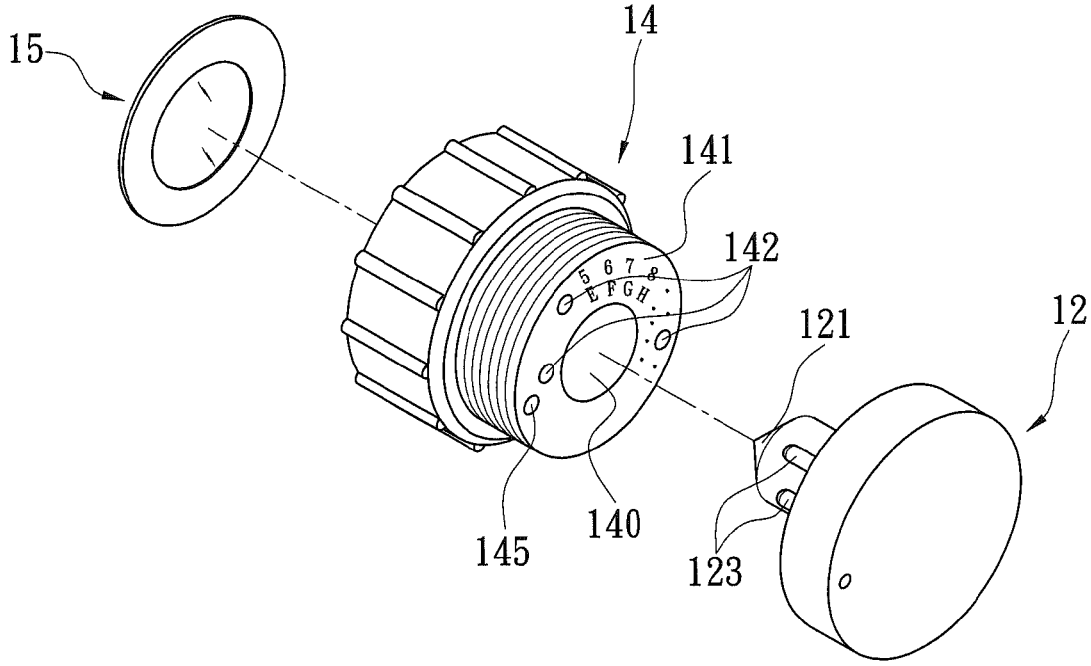
FIG. 4 is an exploded perspective view showing a bottle closure of the present invention.
Figure 5:
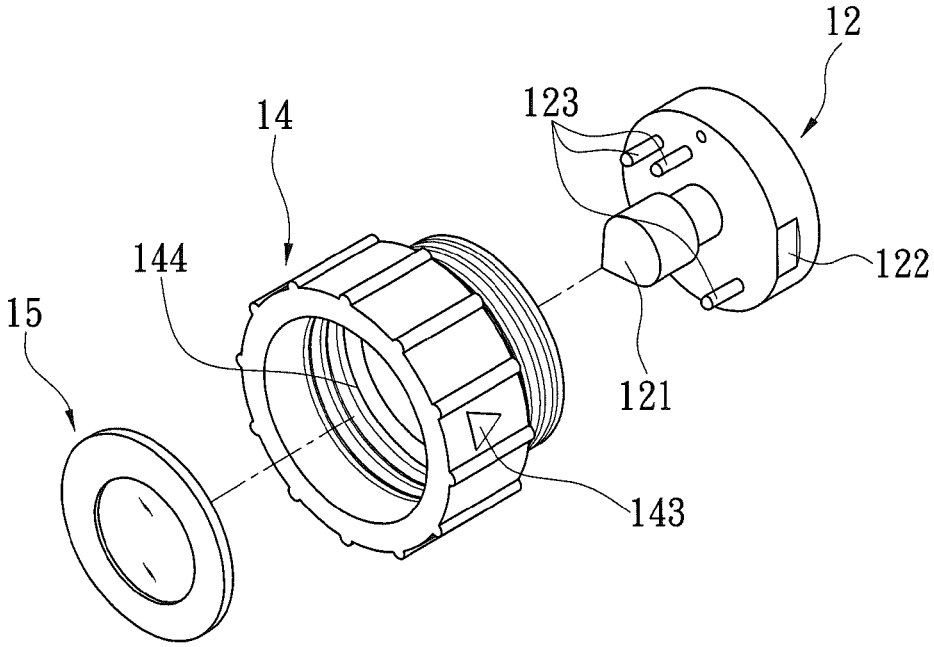
FIG. 5 is another exploded perspective view showing the bottle closure of the present invention.
Figure 6:
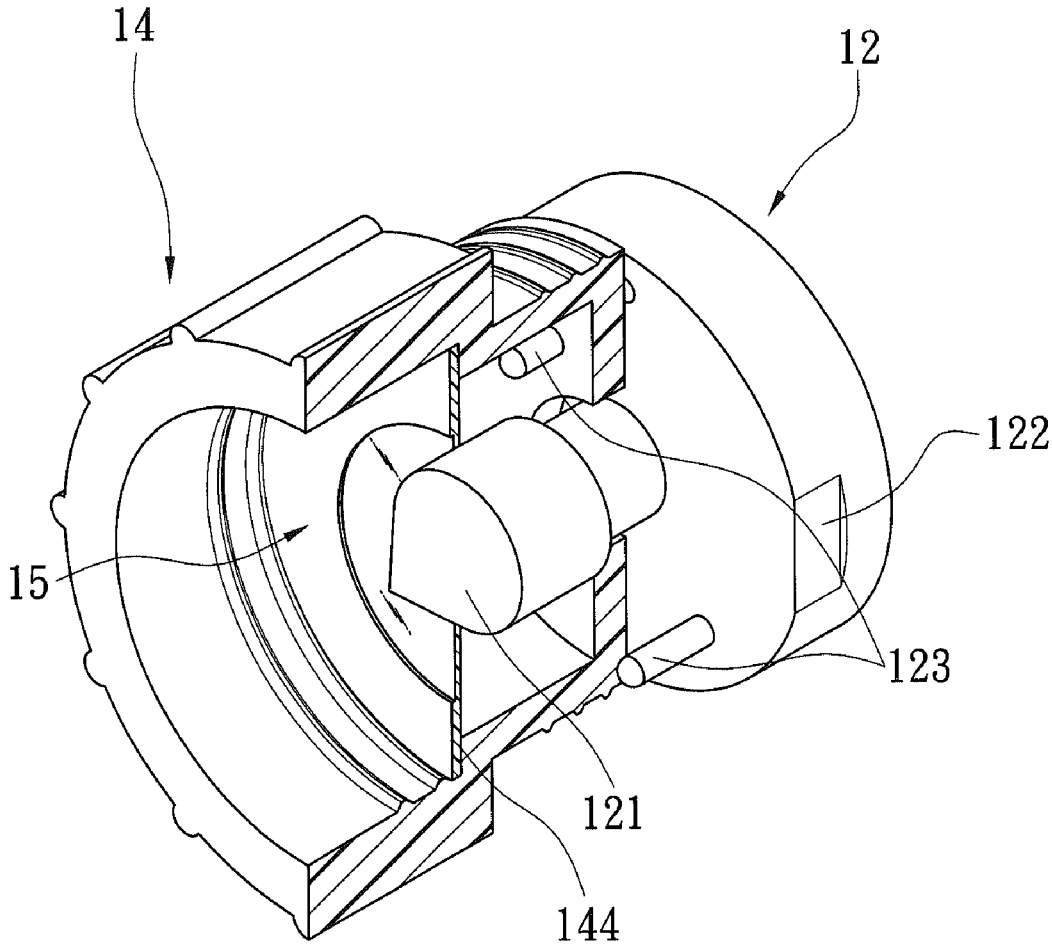
FIG. 6 is another cross-section perspective view showing pre-check member puncturing the bottle closure of the present invention.
Figure 7:
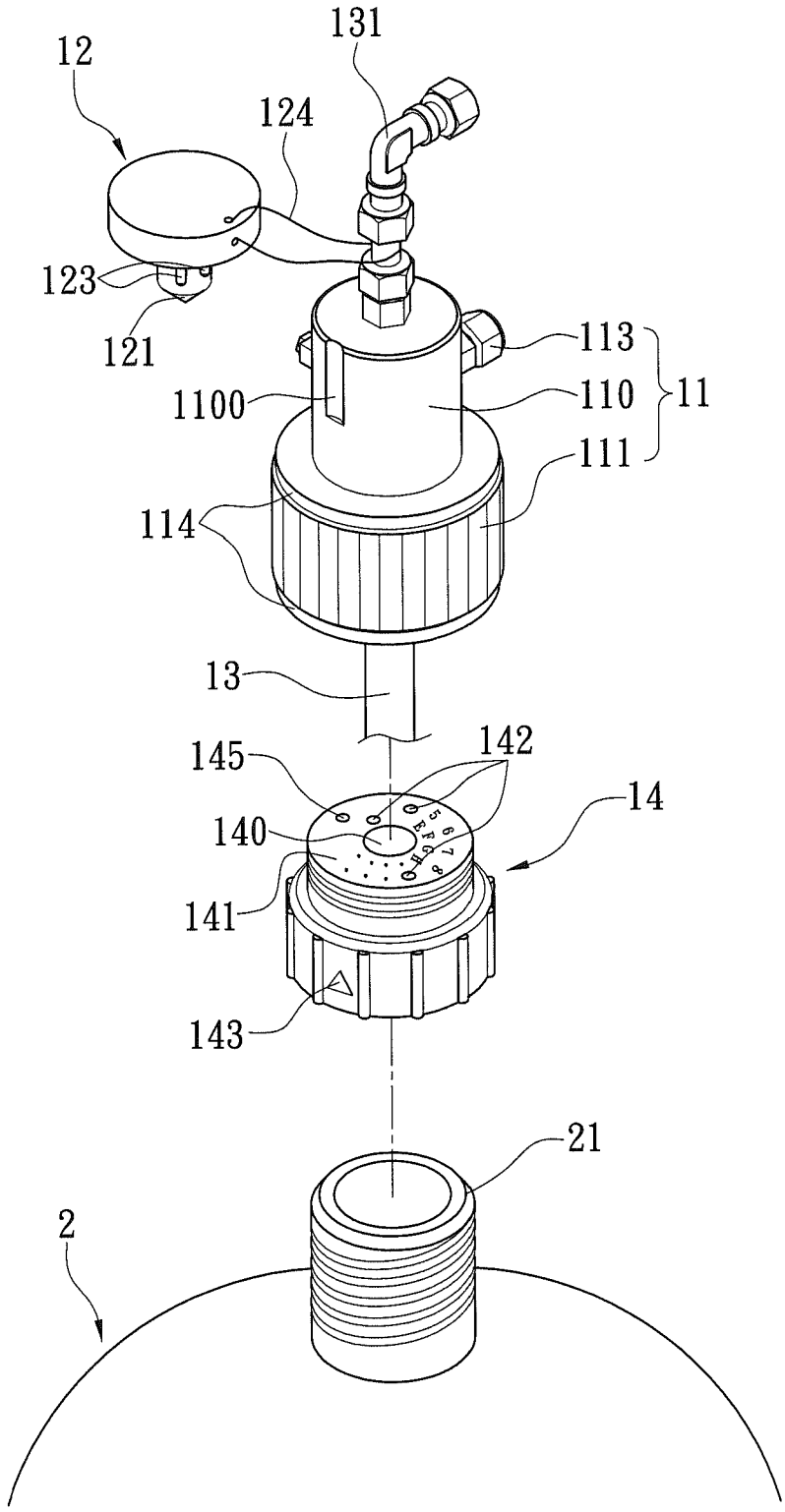
FIG. 7 is an application exploded perspective view showing the connecting device of the present invention.
Figure 8:
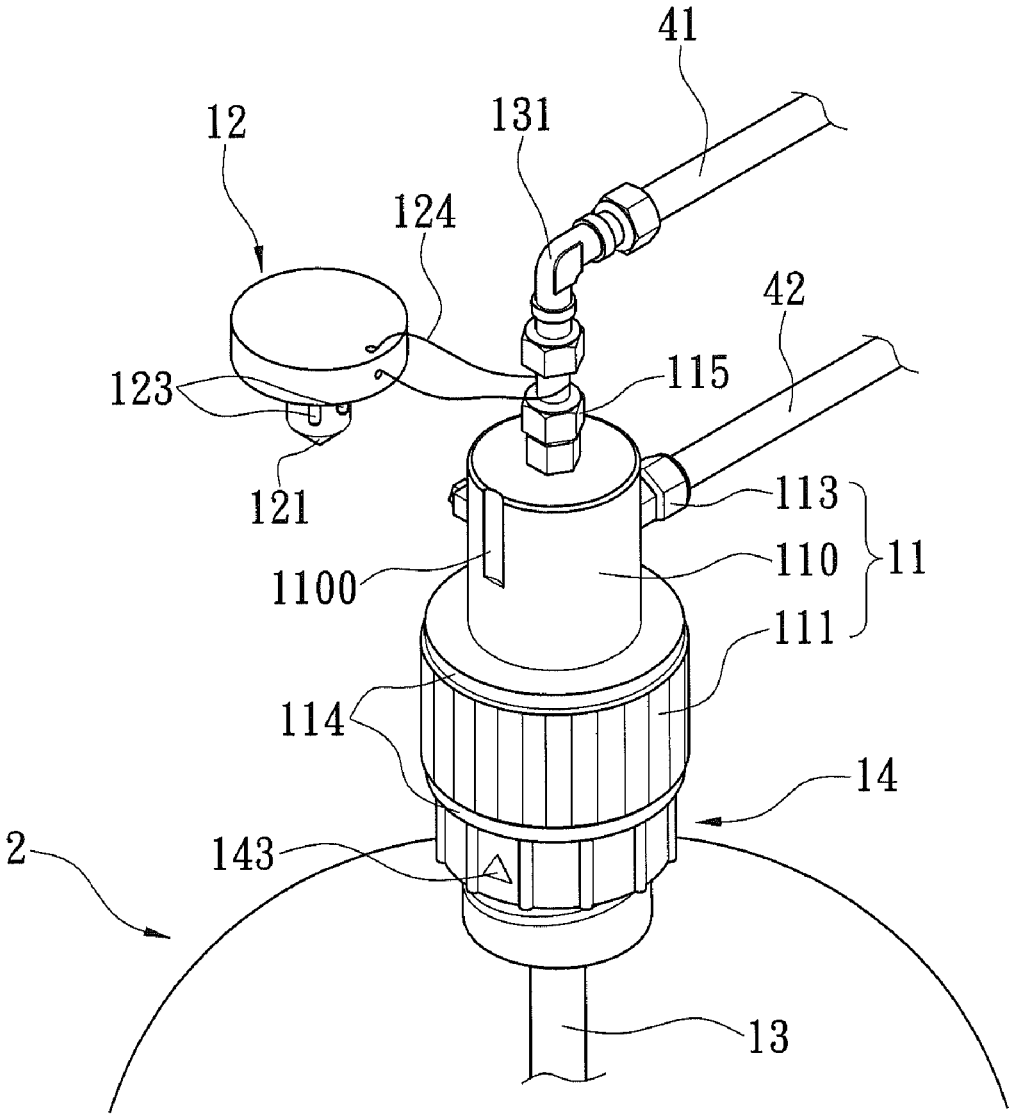
FIG. 8 is an application assembled perspective view showing the connecting device of the present invention.

Reference is made to FIG. 3 FIG. 4, and FIG. 9. The connector 11 further comprises a gas inlet 112, a backflow inlet 113, and a dispensing outlet 131. The upper member 110 has a gas passage 1105 therethrough in communication with the gas inlet 112. The gas inlet 112 can be connected to a gas source, such as nitrogen, to increase the pressure in container 2. The backflow inlet 113 is in communication with the tubular passage 1104. The backflow inlet 113 can be used to recycle the liquid chemical during a manufacturing process. The backflow inlet 113 has a liquid is in communication with the tube passage 1104.

In the instant embodiment, the pre-check member 12 is hanged on the dip tube 13 by a string 124. The pre-check member 12 is shaped into a column. The pre-check member 12 has a puncturing structure 121 for puncturing through the rupturable film 15. Also in the instant embodiment, the pre-check member 12 has a key code pattern consisting three downward protrusions 123. The protrusions 123 are pillars and configured to mate with the first key code pattern 141. The shape and number of the protrusions 123 are not limited to the illustration in the drawings.

Reference is now made to FIG. 4 to FIG. 9. The internal threads of the bottle closure 14 are used to engage the external threads on the mouth 21 of the container 2. The external threads of the bottle closure 14 are used to engage the internal threads of the lower member 111. Before coupling the connector 11 on the bottle closure 14, a handling personnel can use the pre-check member 12 to ensure proper selection of the chemical containers. For example, a specific first key code pattern 141 can be used to represent a specific chemical. The pre-check member 12 has a check mark 122 on the side wall. The check mark 122 is a notch in the instant example, but the shape of the mark is not limit to the illustration in the drawings. If the chemical container is properly selected, the puncturing structure 121 will pass through dip tube passage 140 and punctures the rupturable film 15 when check mark 122 on the pre-check member 12 aligns the first mark 143 of the bottle closure 14. Then, the connector 11 can be coupled to the bottle closure 14 with the dip tube 13 dipping into container 12. Thus, the key code safety mechanism effectively prevents the handling personnel from the installing an incorrect liquid source into a dispensing device 4.

Figure 10:
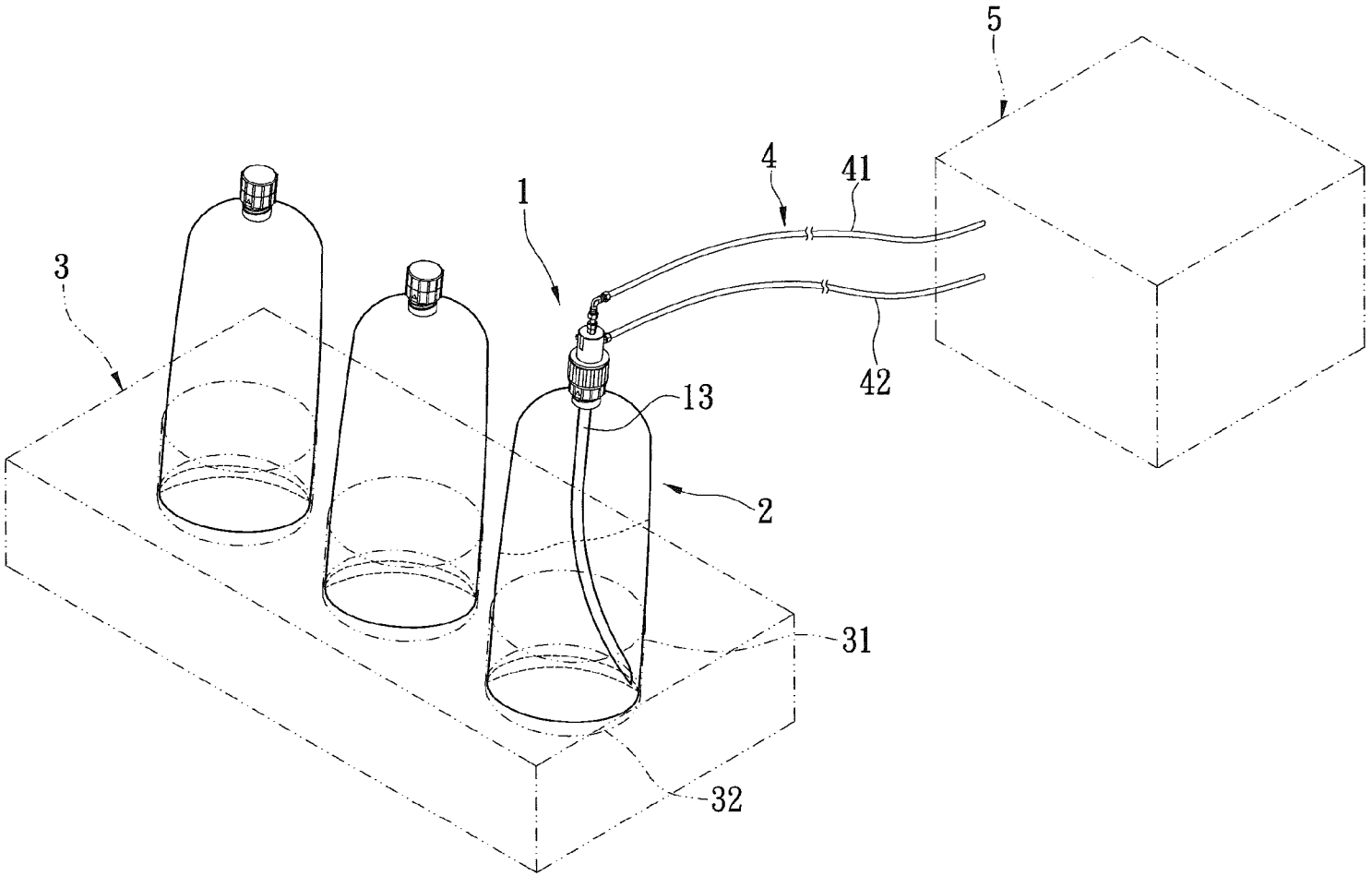
FIG. 10 is a schematic view showing an liquid dispensing system of the present invention.

FIG. 10 shows an embodiment of the liquid chemical dispensing system. The liquid chemical dispensing system comprises a connecting device 1, a container 2, an accommodating seat 3, and a dispensing device 4.

The connecting device 1 has been discussed above. The container 2 has liquid chemical therein. The accommodating seat 3 has an accommodating space 31 and a sloping surface 32 therein for supporting the container 2. In order to improve the strength of the container 2, the bottom of the container 2 is not flat (always shaped into arc), so that it has a lower bottom edge. When the container 2 is placed on the sloping surface 32, the remaining liquid chemical will flow to the lower portion of the bottom edge due to gravity. The lower end of the dip tube 13 is extended downward and bended toward the lower bottom edge of the container 2 in the direction of the sloping surface 32. Therefore, the liquid chemical can be sucked and dispensed to the manufacturing equipment 5 efficiently. The dispensing outlet 131 and the backflow inlet 113 are connected to the manufacturing equipment 5 through the dispensing device 4. The dispensing outlet 131 is a male elbow and configured to face in the direction of the manufacturing device 5 when the system is properly installed and secure in place. The dispensing device 4 has a dispensing tube 41 and a backflow tube 42. The dispensing tube 41 is in communication with the dispensing outlet 131. The backflow tube 42 is in communication with the backflow inlet 113. The connector 11 further comprises a liquid passage 1131, the backflow inlet 113 is in communication with the liquid passage 1131 and the backflow tube 42, so that liquid chemical can pass through the liquid passage 1131 and flow down along the outside wall of the dip tube 13. There is no bubble generated and the remain bubbles will be eliminated.

When the second mark 1100 aligns the first mark 143, the connector 11 is configured to mate with the bottle closure 14. The first mark 143 and the second mark 1100 are opposite to the dispensing tube 41 and the backflow tube 42 (shown in FIG. 8). The first mark 143 and the second mark 1100 can prevent a handling personnel from installing the incorrect container to the system in a dark environment.

The description above only illustrates specific embodiments and examples of the present invention. The present invention should cover various modifications and variations made to the herein-described structure and operations of the present invention, provided they fall within the scope of the present invention as defined in the following appended claims.

What is claimed is:

1. A connecting device for pre-insuring proper connection of chemicals, comprising:

a bottle closure having a dip tube passage and a first key code pattern on a top end;

a rupturable film disposed on the dip tube passage of the bottle closure;

a connector having an upper member and a lower member for coupling with the bottle closure, wherein the upper member comprises a dispensing outlet and the upper surface and a second key code pattern configured to mate with the first key code pattern on the bottom surface, wherein the lower member is pivotally coupled to the upper member;

a dip tube passing through the connector and connecting to the dispensing outlet; and a pre-check member having a puncturing structure for puncturing through the rupturable film, wherein the pre-check member has a key code pattern configured substantially identical to the second key code pattern to mate with the first key code pattern, wherein the puncturing structure of the pre-check member punctures through the rupturable film when the key code pattern thereon mates with the first key code pattern.

2. The connecting device of claim 1, wherein the first key code pattern is a three-hole configuration and the second key code pattern is a three-protrusion configuration matching the of three-hole configuration of the first key code pattern.

3. The connecting device of claim 2, wherein the side wall of the bottle closure has a first mark thereon.

4. The connecting device of claim 3, wherein the side wall of the pre-check member has a check mark thereon, while the check mark aligns the first mark, the three pillars of the pre-check member configured to mate with the three holes, the puncturing structure penetrating the aperture of the bottle closure and puncturing the rupturable film.

5. The connecting device of claim 3, wherein the side wall of the upper member has a second mark thereon, while the second mark aligns the first mark, the three pillars of the connector configured to mate with the three holes.

6. The connecting device of claim 1, wherein the connector further comprises a gas inlet and a gas passage, the gas passage passes through the bottom surface of the upper member and is in communication with the gas inlet.

7. The connecting device of claim 1, wherein the connector further comprises a backflow inlet and a liquid passage permitting the liquid passage through the bottom surface of the upper member.

8. A liquid chemical dispensing system, comprising:

an accommodating seat having a sloping surface;

a container disposed on the sloping surface of the seat having a mouth;

a connecting device comprising a bottle closure for coupling with the mouth of the container, wherein the bottle closure comprises a dip tube passage and a first key code pattern on a top end;

a rupturable film disposed on the dip tube passage of the bottle closure, a connector for coupling with the bottle closure, the connector having an upper member and an lower member, wherein the upper member comprises a dispensing outlet facing the direction of the sloping surface of the seat on an upper surface and a second key code pattern configured to mate with the first key code pattern on a bottom surface;

wherein the lower member is pivotally coupled to the upper member;

a dip tube having an upper end and a lower end, wherein the upper end of the dip tube is connected to the dispensing outlet through the connector and the lower end of the dip tube substantially aligns in the direction of the dispensing outlet; and a pre-check member having a puncturing structure for puncturing through the rupturable film, wherein the pre-check member has a key code pattern configured substantially identical to the second key code pattern to mate with the first key code pattern; and wherein the puncturing structure of the pre-check member punctures through the rupturable film when the key code pattern thereon mates with the first key code pattern.

9. The liquid chemical dispensing system of claim 8, wherein the first key code pattern is a three-hole configuration and the second key code pattern is a three-protrusion configuration matching the of three-hole configuration of the first key code pattern.

10. The liquid chemical dispensing system of claim 9, wherein the side wall of the bottle closure comprises a first mark thereon.

11. The liquid chemical dispensing system of claim 10, wherein the side wall of the upper member has a second mark thereon, while the second mark aligns the first mark, the connector configured to mate with the bottle closure, the first mark and the second mark opposite the dispensing device.

12. The liquid chemical dispensing system of claim 10 wherein the side wall of the pre-check member has a check mark thereon, while the check mark aligns the first mark, the three pillars of the pre-check member configured to mate with the three holes, the puncturing structure penetrating the aperture of the bottle closure and puncturing the rupturable film.

13. The liquid chemical dispensing system of claim 8, wherein the dispensing outlet is a male elbow, the male elbow facing the manufacturing equipment.

14. The liquid chemical dispensing system of claim 13, wherein further comprises a dispensing device which has a dispensing tube in communication with the male elbow.

15. The liquid chemical dispensing system of claim 14, wherein the connector further comprises a backflow inlet and a liquid passage, the backflow inlet in communication with the dip tube passage and the backflow tube, so that liquid chemical can pass through the liquid passage and flow down along the outside wall of the dip tube.

16. The liquid chemical dispensing system of claim 8, wherein the bottle closure further comprises a cover, the cover is coupled to the bottle closure.

* * * * *